US006712463B2

(12) United States Patent
Matsumoto

(10) Patent No.: US 6,712,463 B2
(45) Date of Patent: Mar. 30, 2004

(54) RECORDING APPARATUS

(75) Inventor: Toshiya Matsumoto, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/234,377

(22) Filed: Sep. 5, 2002

(65) Prior Publication Data

US 2003/0048345 A1 Mar. 13, 2003

(30) Foreign Application Priority Data

Sep. 7, 2001 (JP) ..... 2001-271632

(51) Int. Cl.[7] ..... B41J 2/01; B41J 13/10; B41J 13/12; B41J 13/14; B41J 13/16

(52) U.S. Cl. ..... 347/104; 347/101; 271/188; 400/642; 400/646; 400/611; 400/617; 400/636; 346/134

(58) Field of Search ..... 347/104, 101; 271/188; 400/642, 646, 611, 617, 636; 346/134

(56) References Cited

U.S. PATENT DOCUMENTS 5,291,224 A * 3/1994 Asano et al. ..... 346/134
5,874,979 A * 2/1999 Ohyama ..... 347/104
5,980,132 A * 11/1999 Kawai ..... 400/56
6,113,289 A * 9/2000 Saito et al. ..... 400/58
6,293,669 B1 * 9/2001 Uchida ..... 347/104
2002/0021342 A1 * 2/2002 Kawazoe et al. ..... 347/104
2002/0171727 A1 * 11/2002 Kida et al. ..... 347/104

FOREIGN PATENT DOCUMENTS

JP 06115068 A * 4/1994 ..... B41J/2/01
JP 10297039 A * 11/1998 ..... B41J/13/02
JP 2000071532 A * 3/2000 ..... B41J/11/02

* cited by examiner

*Primary Examiner*—Stephen D. Meier
*Assistant Examiner*—Leonard Liang
(74) *Attorney, Agent, or Firm*—Fitzpatrick, Cella, Harper & Scinto

(57) ABSTRACT

A recording apparatus has a sheet conveyor and platen provided with plural extrusions for supporting the sheet material in the recording area, the plural extrusions being arranged perpendicular to the conveying direction of the sheet material at designated intervals in a configuration of being extended in the conveying direction, plural sheet-discharging rollers downstream of each of the extrusions in the conveying direction and in the same position as each of the extrusions in the intersecting direction, plural first spurs for nipping a sheet material with the plural sheet-discharging rollers, and a second spur downstream of the first spur and between the plural sheet-discharging rollers in the intersecting direction, being driven to rotate following the movement of a sheet material to push down the sheet material between the plural extrusions, the lowest part of the second spur being arranged to be lower than the uppermost part of the sheet-discharging roller when the sheet material does not abut thereupon.

8 Claims, 9 Drawing Sheets

RECORDING APPARATUS

BACKGROUND OF THE INVENTION

1. Field of the Invention

The present invention relates to a recording apparatus provided as a printer, a copying machine, a facsimile equipment, or the like, and to a recording apparatus used as the output equipment of complex type electronic equipment or a work station such as a computer, a word processor, or the like. More particularly, the invention relates to a recording apparatus provided with recording means for recording by use of color liquid (ink) on a recording material, which is a sheet material, and also, with discharging means for discharging a recording material from a recording area of the recording means.

2. Related Background Art

The recording apparatus provided with a printer, a copying machine, facsimile equipment, or the like, or the recording apparatus, which is used for output equipment of complex type electronic equipment or a work station such as a computer, a word processor, or the like is structured to perform recording images on a recording material (recording sheet), such as a paper sheet or thin plastic plate, in accordance with image information. The recording apparatus of the kind is classified by the recording method adopted therefor into ink jet type, wire-dot type, thermal type, laser beam type, among some others.

The serial scanning type recording apparatus adopts the serial scanning method of performing a main scan in the direction intersecting with the conveying direction of a recording material (sub-scanning direction), and has recording means mounted on a cartridge that travels along the recording material to record images (conducts main scanning). After one-line portion of recording is completed, a sheet feeding (pitch conveyance) in a designated amount is executed, and then, subsequently, images on the next line are recorded (main scanned) on the recording material that has come to a stop again. This operation is repeated to record entirely on the recording material.

On the other hand, for the recording apparatus of line type that records only by the sub-scanning in the conveying direction of a recording material, it is arranged to set a recording material on a designated recording position, and after recording a one-line portion altogether, a sheet feed in a designated amount (pitch conveyance) is conducted, and then, recording on the next line is performed altogether. This operation is repeated to record entirely on the recording material.

Of the recording apparatuses described above, a recording apparatus of ink jet type (ink jet recording apparatus) performs recording on a recording material by discharging ink from recording means (recording head), which makes it possible to make recording means compact, and to record images in high precision at high speed. Also, the recording apparatus of this type can record on a plain paper without giving any particular treatment, thus making the running costs lower. Also, because of non-impact type, it makes a lesser amount of noise with an advantage, among some others, that it can record color images with ease using ink of many colors. Of the ink jet recording apparatuses, a higher recording is possible by the line type apparatus, which uses recording means of line type where many discharge ports are arranged in the widthwise direction of a recording sheet.

FIGS. 7 to 9 are cross-sectional views that schematically Illustrate the structure around the recording area of the conventional ink jet recording apparatus. As shown in FIG. 7, the recording sheet P, which is fed by a sheet-feeding device (not shown), is nipped by a conveying roller 101 and a pinch roller 102, and conveyed to the recording area of the recording head 103, while the non-recording side thereof is being supported by a platen 106. The recording head 103 discharges ink to the recording sheet P for recording images on the recording sheet P. After images are recorded by the recording head 103, the recording sheet P is nipped by a sheet-discharging roller 104 and a spur 105, which are arranged on the downstream side in the conveying direction, and discharged by the rotations of the sheet-discharging roller 104 and the spur 105.

Now, it is assumed that a distance between the recording 103 and the recording sheet P is L. In an ink jet recording apparatus, the ink-jetted positions may delicately change depending on the distance between the recording head 103 and the recording sheet P. Therefore, if such distance is kept at a designated distance (L, for instance) all over the recording area, that is, if the recording sheet P can be placed along the platen 106 exactly, it should be possible to obtain images in high quality. Now, in the conventional ink jet recording apparatus, therefore, the rotational axis of the pinch roller 102 and the rotational axis of the spur 105 are often arranged to be offset more to the platen 106 side than the rotational axis of the conveying roller 101 and the rotational axis of the sheet-discharging roller 104 in order to place a recording sheet P along the platen 106 arranged on the lower side of the recording head 103.

Also, since the ink jet recording apparatus uses ink for recording, a recording sheet P is caused to expand when ink permeates the recording sheet P, and the recording surface of the recording sheet P waves (present cockling) on the recording area. Then, if the recording sheet P should float significantly from the platen 106 due to such cockling, not only do the positions of ink on the recording sheet deviate, but also, the recording surface is stained due to the recording head 103 that rubs the recording sheet P or the recording head 103 may be deteriorated or damaged if the recording head 103 collides with the edge portion of the recording sheet P.

Now, therefore, as shown in FIG. 8, the escapes 106' and 104' where a recording sheet P is made displaceable downward are provided for the platen 106 and the sheet-discharging roller 104 of the conventional ink jet recording apparatus, and also, the spur 107 is arranged to push the recording sheet P compulsorily into the escapes 106' and 104' of the platen 106 and the sheet-discharging roller 104. In this manner, the recording sheet P is allowed to wave downward regularly within the range of a designated height, hence preventing the recording sheet P from floating up.

However, when the leading end of the recording sheet P enters the spur 105 in the conventional structure as shown in FIG. 9, the leading end of the recording sheet P is pushed downward by the pushing-down spur 107. Because of reaction then, the recording sheet P on the recording area is caused to float up eventually (the condition indicated by solid line in FIG. 9) or the pushing-down spur 107 exerts resistance against the conveying force of the recording sheet P and buckles the recording sheet P, thus causing it to float up on the recording area eventually (the condition indicated by two-dot chain line in FIG. 9). Then, such defects as the degradation of recorded image, the deterioration of a recording head, or damages given thereto, may be invited in some cases.

As described above, the conventional recording apparatus is,provided with a pushing-down spur that pushes down a recording sheet compulsorily to a platen and the escape portion of a sheet-discharging roller in order to prevent the recording sheet from being cockled. However, when the leading end of the recording sheet enters the spur, the leading end of the recording sheet is pushed downward by the pushing-down spur, and by reaction exerted then, the recording sheet is caused to float up on the recording area or the pushing-down spur exerts resistance to the conveying force of the recording sheet to buckle the recording sheet, thus causing it to float up on the recording area eventually. As a result, there is a problem that may be encountered such as the degradation of recorded image, the deterioration of the recording head or damages given thereto.

SUMMARY OF THE INVENTION

It is an object of the present invention to provide a recording apparatus capable of high-quality recording on the entire area of a recording sheet even if the recording sheet expands by the permeation of ink It is another object of the invention to provide a recording apparatus for recording on a sheet material by recording means, which comprises conveying means for conveying the sheet material to the recording area of recording means; a platen provided with plural extrusions for supporting the sheet material in the recording area, the plural extrusions being arranged in the direction intersecting with the conveying direction of the sheet material at designated intervals in a configuration of being extend in the conveying direction; plural sheet-discharging rollers for conveying a sheet material arranged on the downstream side of each of the extrusions in the conveying direction and in the same position as each of the extrusions in the intersecting direction: plural first spurs for nipping a sheet material with the plural sheet-discharging rollers for conveyance thereof by being driven to rotate following the plural sheet-discharging rollers; and a second spur arranged on the downstream side of the first spur in the conveying direction and between the plural sheet-discharging rollers in the intersecting direction, for rotating following the movement of a sheet material to push down the sheet material between the plural extrusions, the lowest part of the second spur being arranged to be lower than the uppermost part of the sheet-discharging roller when the sheet material does not abut thereupon.

DESCRIPTION OF THE PREFERRED EMBODIMENTS

Figure 1:
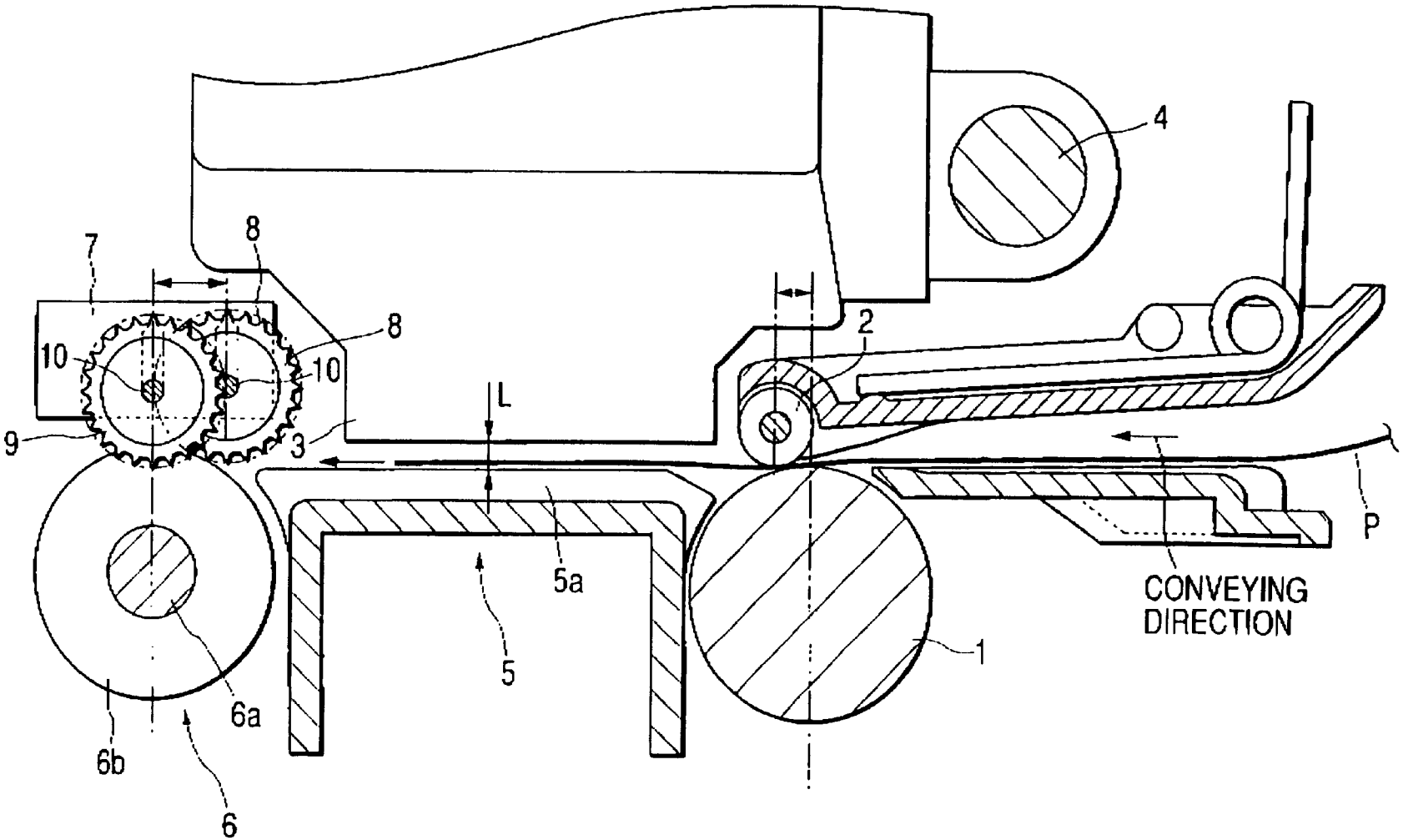
FIG. 1 is a cross-sectional view that schematically shows the circumference of the recording area of a recording apparatus in accordance with one embodiment of the present invention.
Figure 2:
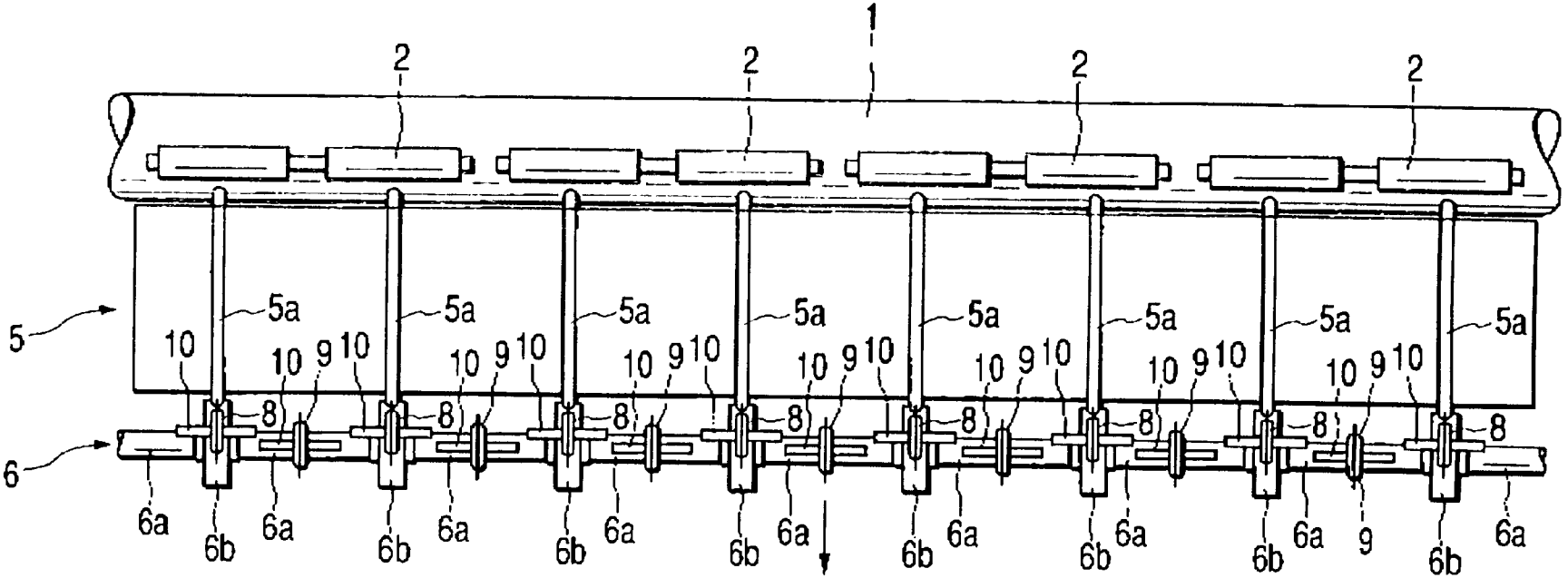
FIG. 2 is a plan view that schematically shows the circumference of the recording area of the recording apparatus in accordance with one embodiment of the present invention, observed from the recording surface side (from above).
Figure 3:
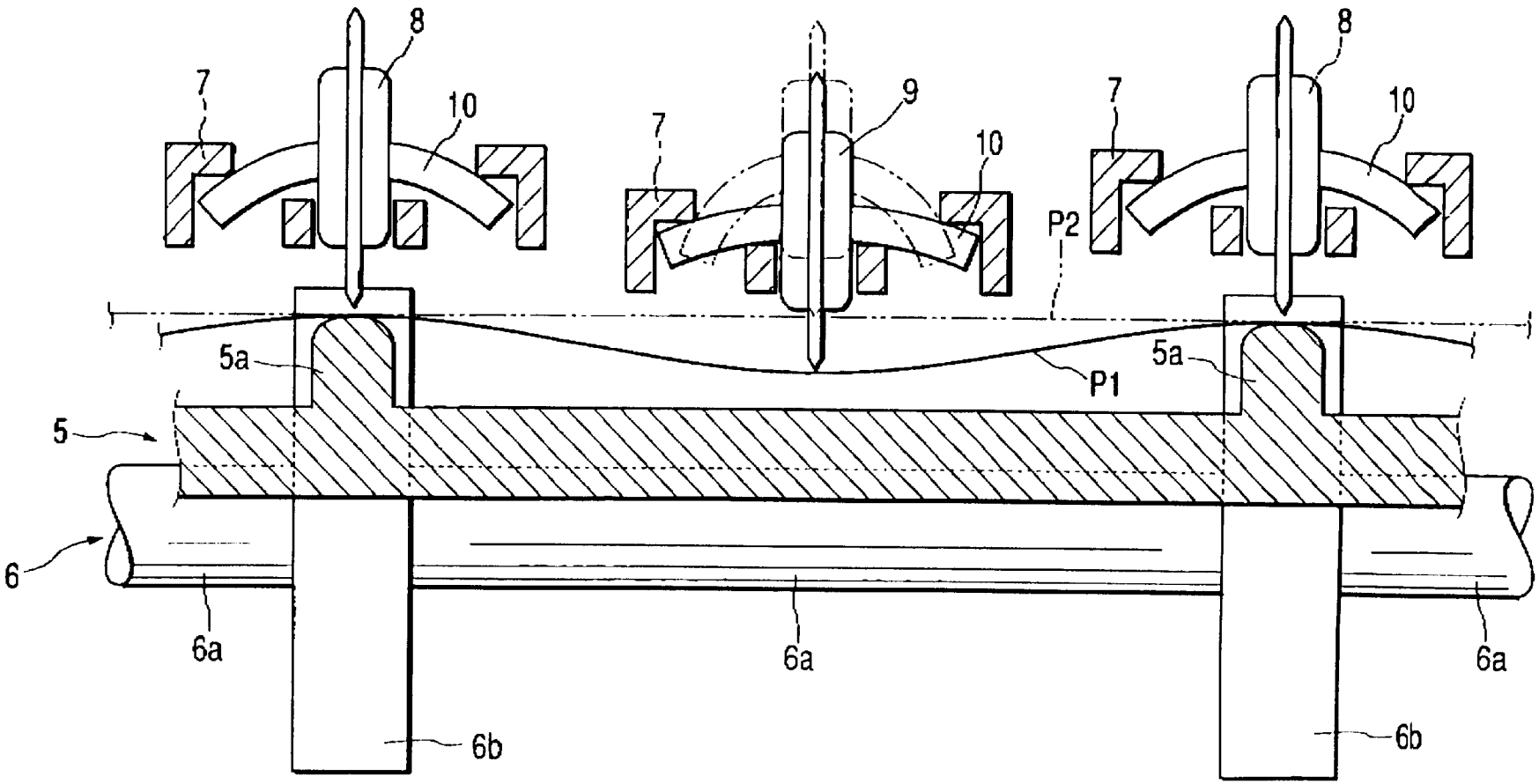
FIG. 3 is a cross-sectional view that schematically shows the circumference of the recording area of the recording apparatus in accordance with one embodiment of the present invention, observed in the conveying direction.

At first, with reference to the accompanying drawings, the description will be made of a recording apparatus embodying the present invention. In all the accompanying drawings, the constituents having the same reference marks provided therefor are all the same. In FIGS. 1 to 3 are views that illustrate the structure on the circumference of the recording area of the recording apparatus embodying the present invention. FIG. 1 is a cross-sectional view that schematically shows the circumference of the recording area of a recording apparatus in accordance with one embodiment of the present invention. FIG. 2 is a plan view that schematically shows the circumference of the recording area of the recording apparatus in accordance with one embodiment of the present invention, observed from the recording surface side (from above). FIG. 3 is a cross-sectional view that schematically shows the circumference of the recording area of the recording apparatus in accordance with one embodiment of the present invention, observed in the conveying direction.

In FIGS. 1 to 3, a reference numeral 1 designates a conveying roller, and reference numeral 2 designates a pinch roller arranged in a plural number in the widthwise designates direction of a recording sheet P. The pinch roller 2 is in contact with the conveying roller 1 under pressure by use of a spring (not shown). In cooperation with the pinch roller 2, the conveying roller 1 nips the recording sheet P to convey it, and thus pinch roller 2 and conveying roller 1 may serve as conveying means. The conveying roller 1 is driven by a carrier motor (not shown) to rotate, and conveys the recording sheet P a designated amount. Above the recording sheet P thus conveyed by the conveying roller 1, there is arranged a recording head 3. The recording head 3 is supported by the guide shaft 4, which is fixed in parallel to the conveying roller 1, and a guide rail (not shown), so as to enable to reciprocate in the direction intersecting with the conveying direction of the recording sheet P. Recording head driving means (not shown) controls the operation of the recording head 3. The recording head 3 is an ink jet recording type of recording head for discharging ink to record on a recording sheet P. On the recording area of the recording head 3, there is arranged a platen 5 on the non-recording surface side of a recording sheet P. The platen 5 is arranged in a plural number in the widthwise direction of the recording sheet P at designated intervals, and provided with an extrusion 5*a* that extrudes in the conveying direction of the recording sheet P. Here, the rotational shaft of the pinch roller 2 is arranged in a position deviated to the platen 5 side by a designated amount from the right above the rotational shaft of the conveying roller 1 in order to enable the extrusion 5*a* of the platen 5 to abut against the recording sheet p reliably.

On the downstream side of the platen 5 in the conveying direction, there is arranged a sheet-discharging roller 6 that rotates when the driving of the conveying roller 1 is transmitted thereto. The sheet-discharging roller 6 is provided integrally with the axial portion 6*a,* which serves as the rotational shaft, and plural rubber rollers 6*b* arranged in the widthwise direction of a recording sheet P. The arrangement position of each rubber roller 6*b* is identical to that of the extrusion 5*a* of the platen 5 in the widthwise direction of a recording sheet P. Above the sheet-discharging roller 6, a spur base 7 is fixed. For the spur base 7, a plurality of nipping spurs 8, each serving as a first spur, and a plurality of pushing-down spurs 9, each serving as a second spur, are supported through each of plural spur springs 10 so as to be rotative and movable up and down in each of the designated positions.

The nipping spur 8 and the pushing-down spur 9 are in the same configuration, and in order to avoid pressure marks and ink marks on the recording sheet P to which ink is not fixed yet adheres immediately after recording, these spurs are provided each with a thin circular plate with the saw teeth having plural acute extrusions formed on the outer circumference thereof (preferably, SUS or the like of plate pressure of approximately 0.1 mm). The surface of edge tip is given water-repellent treatment.

Also, for the central portions of the nipping spur 8 and the pushing-down spur 9, holes are provided, through each of which a spur spring 10 is arranged. The spur spring 10 is an elastic shaft having SUS wire or the like wound around it, and the spur base 7 supports both ends of the spur spring 10. The nipping spurs 8 are arranged to face rubber roller portions 6*b* of the sheet discharging rollers 6, respectively, and by means of the spur spring 10, these are in contact with the rubber roller portions 6*b* under pressure. Also, the rotational shaft of the nipping spurs 8 is arranged in a position deviated by a designated amount to the platen 5 side from immediately above the axial portion 6*a* of the sheet-discharging rollers 6 by the spur base 7. In this way, force is generated to press a recording sheet P to the extrusion 5*a* of the platen 5.

Each of the pushing-down spurs 9 is arranged to face the axial portion 6*a* positioned almost in the middle of the rubber roller portion 6*b* of the sheet-discharging roller 6, respectively, and supported by the spur base 7 almost immediately above the sheet-discharging roller 6. Also, the lowest part of each pushing-down spur 9 is supported by the spur spring 10 in a state of being charged downward to a position lower than the uppermost part of the rubber roller portion 6*b* with the recording sheet P being not in contact In other words, each pushing-down spur 9 is positioned so that it bites into the conveyance path of a recording sheet P, and supported escapable in the thickness direction of the recording sheet P, and also, rotatably following the conveyance of the recording sheet P. On the downstream side of the sheet-discharging roller 6 in the conveying direction, there is arranged an discharging tray (not shown) to stack and hold each recording sheet P having been discharged.

Figure 4:
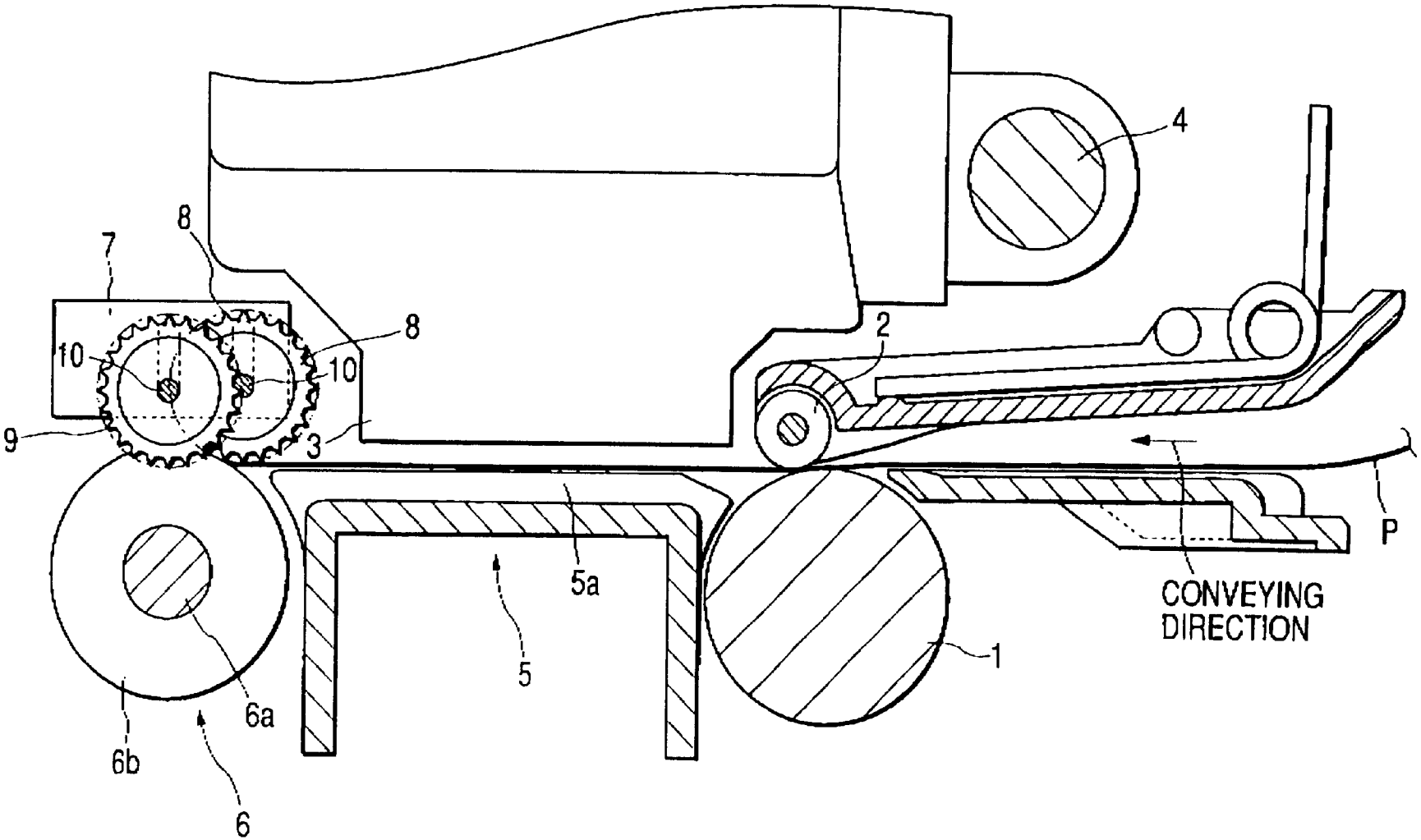
FIG. 4 is a cross-sectional view that schematically illustrates the condition of a recording sheet P in the recording apparatus shown in FIG. 1 embodying the present invention.

With the structure described above, the recording sheet P that has been fed from a feeding portion (not shown) is conveyed to the recording area, that is, onto the platen 5, by use of the conveying roller 1 and pinch roller 2. When images are formed on the recording sheet P, the recording head 3 moves to the column position (the position intersecting with the conveying direction of a recording sheet P) where images are formed, while the recording sheet P is conveyed to the line position (the position in the conveying direction of a recording sheet P) where images are formed, thus enabling the recording head 3 to face the position of image formation. After that, the recording head 3 discharges ink to the recording sheet P in accordance with signals from an electric base plate (not shown) for the formation of images. In the recording apparatus embodying the present invention, the image formation per line is repeated by a desired number of lines, thus effectuating the formation of an arbitrary image on the recording sheet P one after another. When a recording sheet P is in a state as shown in FIG. 1, the recording sheet P is pressed to the extrusion 5*a* of the platen 5 by the pushing force of the pinch roller 2, which is offset. Then, the non-recording side of the recording sheet P abuts against the extrusion 5*a* of the platen 5, hence keeping the distance L between the recording head 103 and the recording sheet P. Further, then, when the recording sheet P is conveyed to be in the state as shown in FIG. 4, the leading end of the recording sheet P is drawn, without being buckled, into the nipping portion (contact part) between the rubber roller portion 6*b* of the sheet-discharging roller 6 and the nipping spur 8, which are positioned substantially at the same height.

When the leading end of the recording sheet P abuts against the pushing-down spur 9, it receives reaction from the pushing-down spur 9. At this juncture, however, the rubber roller portion 6*b* and the nipping spur 8 nips the leading end of the recording sheet P. Therefore, the reaction from the pushing-down spur 9 is not transmitted up to the recording area. Further, since the recording sheet P is pressed to the extrusion 5*a* of the platen 5 by the offset nipping spur 8, the distance L between the recording sheet P and the recording head 3 is kept constantly.

Figure 5:
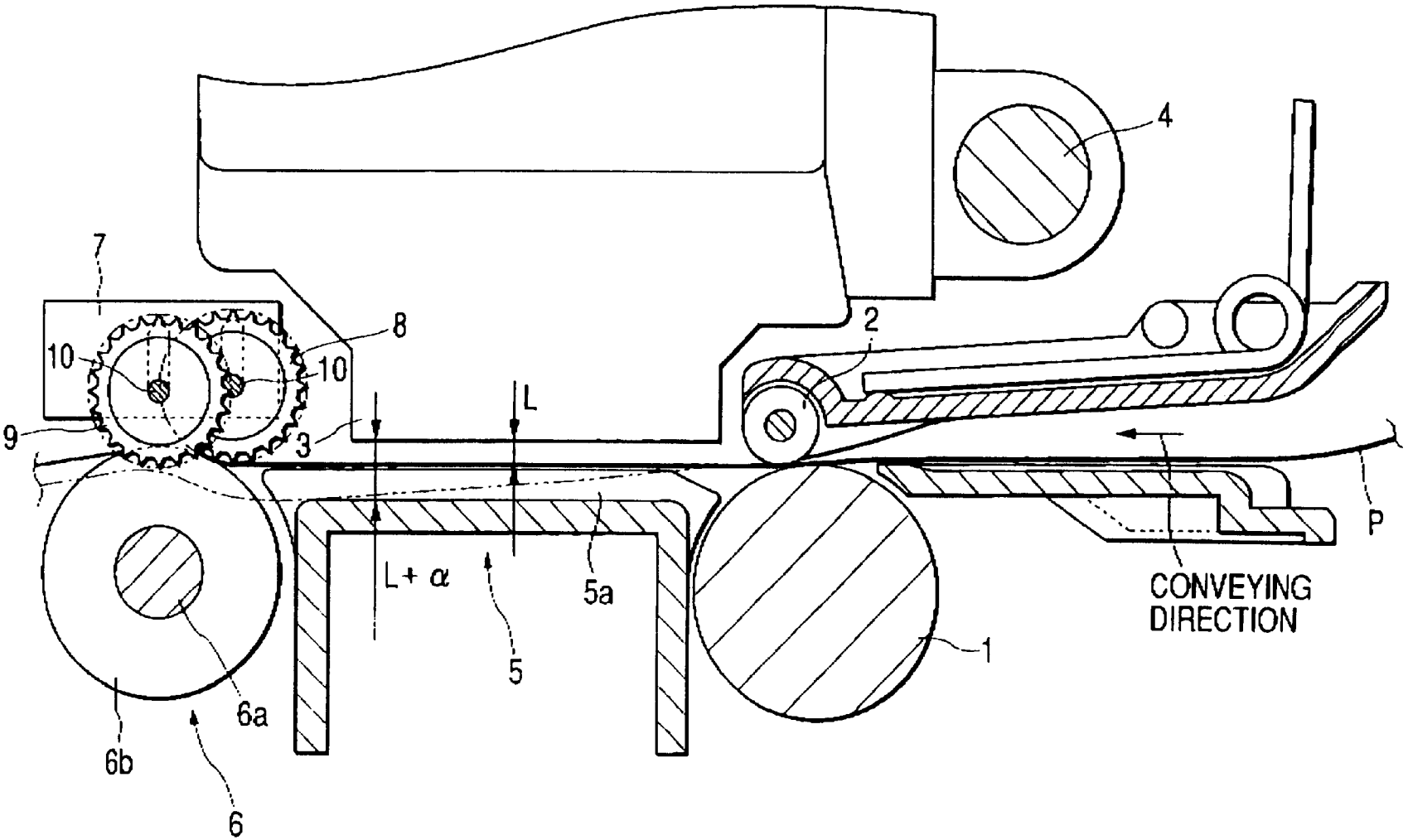
FIG. 5 is a cross-sectional view that schematically illustrates the condition of an expanded recording sheet P by use of in the recording apparatus shown in FIG. 1 embodying the present invention.

Further, when the biasing force exerted by the pushing-down spur 9 by way of the spur spring 10 is added to the leading end of a recording sheet P, the recording sheet P is locally pushed down by an amount corresponding to the expansion thereof resulting from the rigidity of the recording sheet P or the permeation of ink into it. For example, if a recording sheet P is a plain paper or a recycled paper having a low rigidity, which is easy to be expanded by the permeation of ink, and if a large amount of ink is discharged onto such recording sheet P, the recording sheet P is pushed down largely by use of the pushing-down spur 9 as indicated by solid line In FIG. 3, thus presenting larger waving state. Here, the condition (state) of recording sheet P in the position of the nipping spur 8 in the widthwise direction of the recording sheet P is indicated by solid line in FIG. 5, and the condition of the recording sheet P in the position of the pushing-down spur 9 in the widthwise direction of the recording sheet P is indicated by two-dot chain line in FIG. 5. The distance between the recording head 3 and the recording sheet P is L in the position of the nipping spur 8, and in the position of the pushing-down spur 9, it is $L+\alpha$, that is, the amount $\alpha$, which corresponds to the expansion of the recording sheet P caused by the rigidity of recording sheet or the permeation of ink, is added to that distance.

Figure 6:
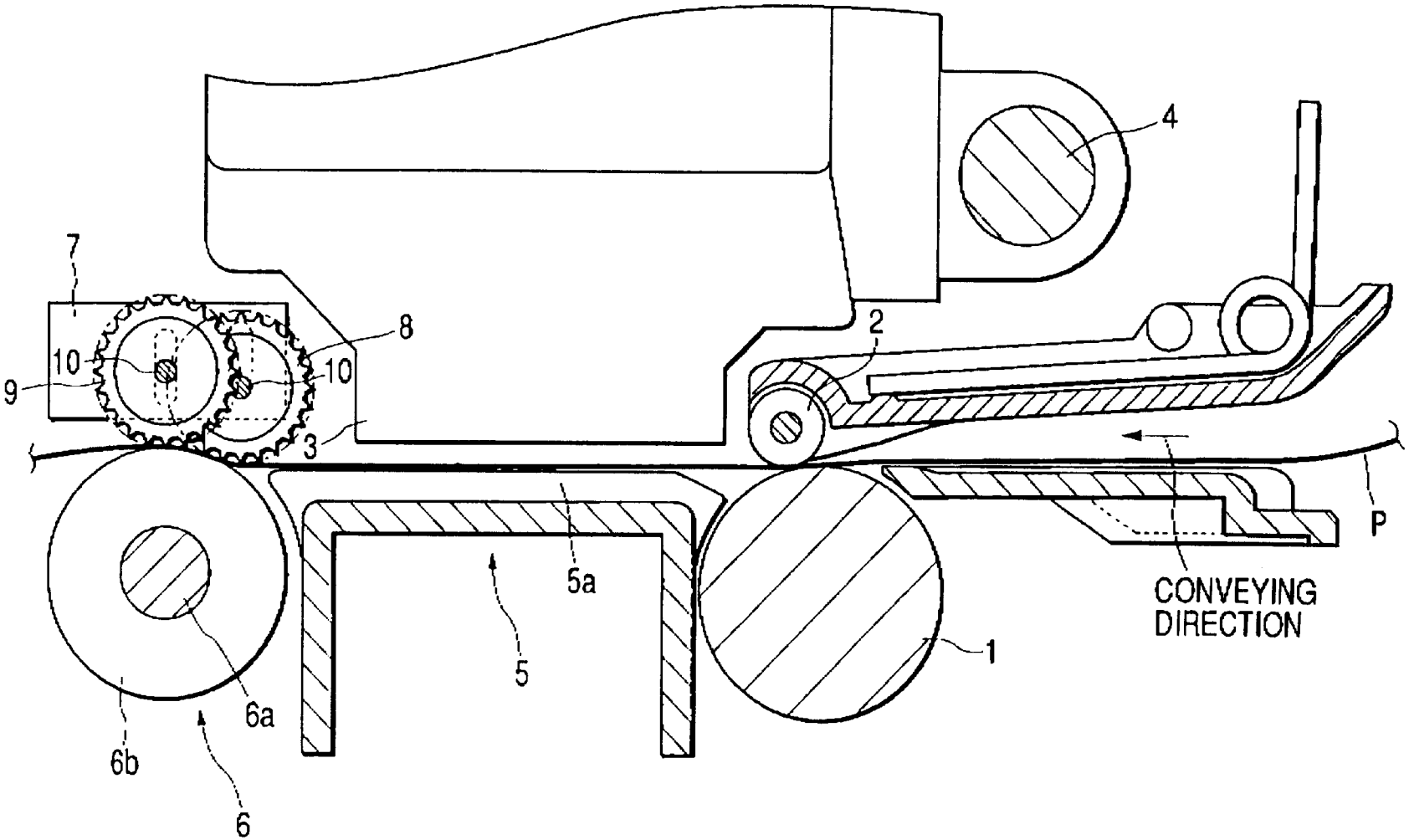
FIG. 6 is a cross-sectional view that schematically illustrates the condition of a highly rigid and rarely expanded recording sheet P in the recording apparatus shown in FIG. 1 embodying the present invention.
Figure 7:
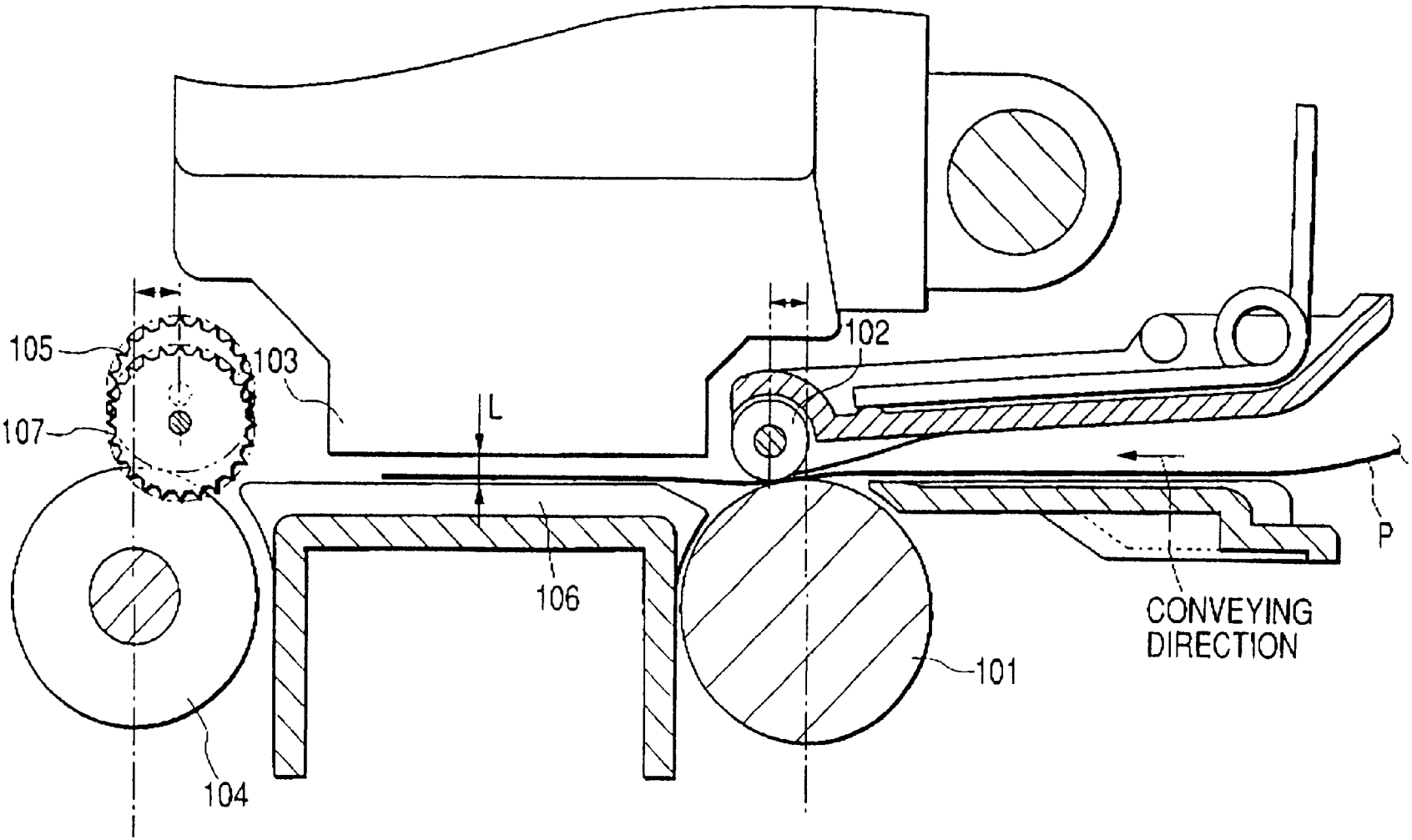
FIG. 7 PRIOR ART
FIG. 7 is a cross-sectional view that schematically shows the structure on the circumference of the recording area of the conventional ink jet recording apparatus.
Figure 8:
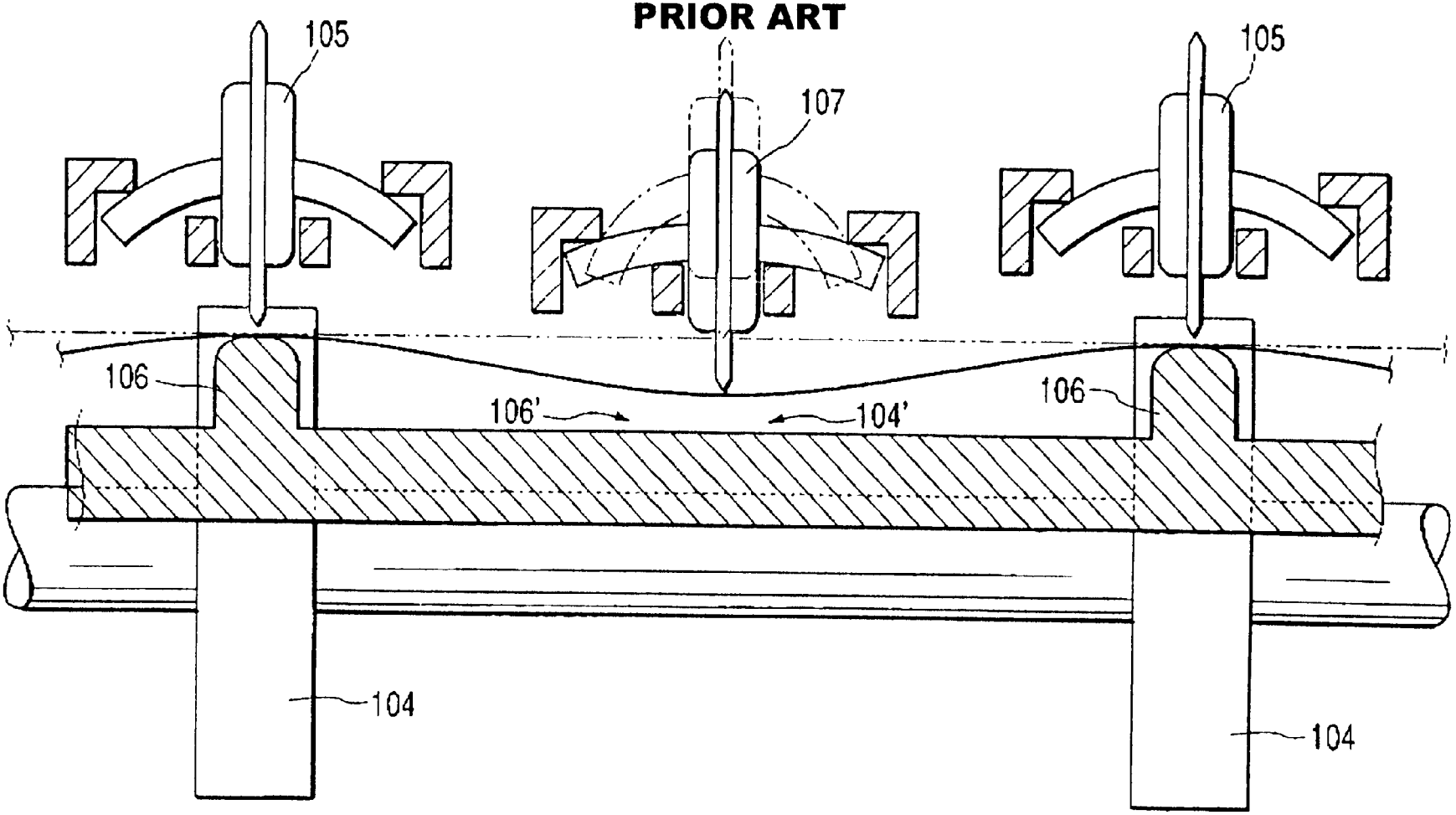
FIG. 8 PRIOR ART
FIG. 8 is a cross-sectional view that schematically shows the circumference of the recording area of the conventional recording apparatus, observed in the conveying direction.
Figure 9:
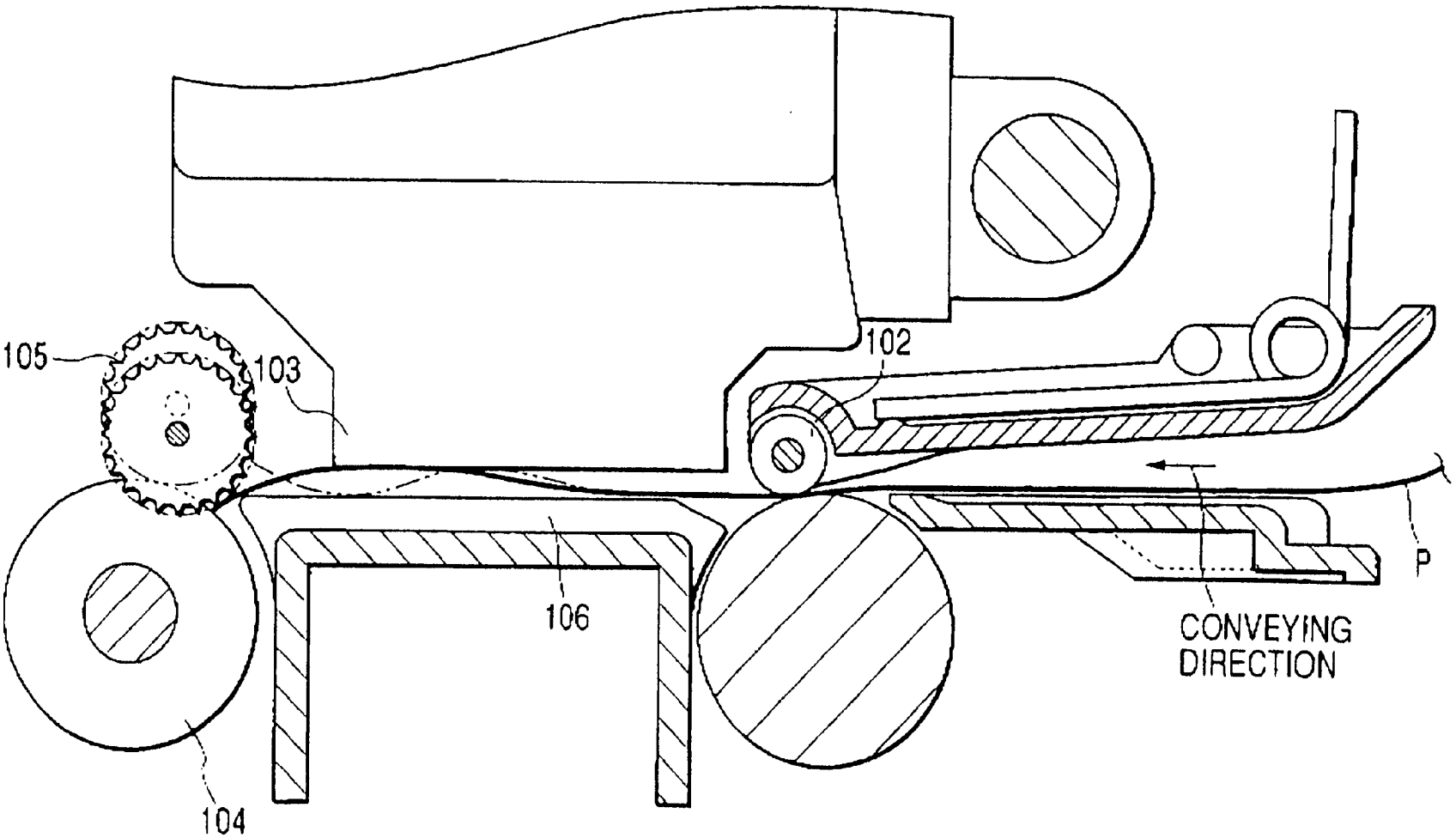
FIG. 9 PRIOR ART
FIG. 9 is a cross-sectional view that schematically illustrates the condition of a recording sheet P in the conventional recording apparatus.

Also, if a recording sheet P is the sheet with a film base material having high rigidity, which is not easily expanded with permeation of ink, such recording sheet P presents a flat condition as indicated by two-dot chain line in FIG. 3 or solid line in FIG. 6. As shown in FIG. 3, the pushing-down spur 9 is pushed up more in this case than the case where a plain sheet or the like is used. The waving conditions of recording sheet P as described above are not necessarily limited to the leading end portion of a recording sheet P, but even in the central portion of the recording sheet P, it is pushed down in an amount corresponding to the expansion of recording sheet P due to rigidity or ink.

Consequently, the distance between the recording head 3 and a recording sheet P is maintained at L or $L+\alpha$ over the entire area of the recording sheet P. Then, the recording sheet P on which images are formed by the recording head 3 is nipped and conveyed by the sheet-discharging roller 3, and a plurality of nipping spurs 8 and pushing-down spurs 9, and discharged to the sheet-discharging tray (not shown).

As described above, in the recording apparatus embodying the present invention, the pushing-down spur 9, which pushes in a recording sheet P between the extrusions 5*a* and 5*a* of the platen 5, is arranged more on the downstream side than the nipping spur 8 in the conveying direction. In this way, the reaction exerted by the abutting of the pushing-down spur 9 is not transmitted up to the recording area portion of a recording sheet P. Also, with the pushing-down spur 9 that pushes in a recording sheet P between the extrusions 5*a* and 5*a* of the platen 5, it becomes possible to keep the distance between the recording sheet P and the recording head 3 at a designated value of L or more. As a result, even if the recording sheet P expands by the permeation of ink, there is no possibility that the recording sheet P floats from the platen 5, hence making it possible to attain recording in high quality all over the entire area of the recording sheet P.

Also, the pushing-down spur 9 is made movable by the reaction of a recording sheet P against biasing force, thus keeping the amount of waving optimally for the recording sheet P depending on the expansion, rigidity, or the like of the recording sheet P to make high-quality recording possible.

Further, it is arranged to make the height of the contacting portion between the rubber roller portion 6*b* of the sheet-discharging roller 6 and the nipping spur 8 substantially equal to the height of the extrusion 5*a* of the platen 5. Therefore, the rubber roller portion 6*b* and the nipping spur 8 nips and discharges the recording sheet P without buckling the recording sheet P.

In this respect, among recording apparatuses of ink jet recording type, the present invention demonstrates particularly excellent effect for the recording head and recording apparatus of the type, which is provided with means (electrothermal converting element, laser beam, or the like) for generating thermal energy as energy to be utilized for performing ink discharges, thus creating changes in the state of ink. With a recording apparatus of such type, it is possible to attain recording in higher precision at higher density than recording apparatuses of other types.

Further, the present invention is effectively applicable to a full-line type recording head that has a length corresponding to the maximum width of a recording medium, which is recordable by such recording apparatus. A recording head of the kind may be structured whether to satisfy such length by the combination of plural recording heads or to form it integrally as one-piece recording head.

In addition, in the serial type recording head as the present embodiment, the invention is effective even when using (1) a recording head fixed to the apparatus main body, (2) a recording head of exchangeable chip type, which is mounted in the apparatus main body to thereby enable electrical connection with the apparatus main body and also the ink supply from the apparatus main body, or (3) a recording head of cartridge type having an ink tank integrally formed with the recording head itself.

Also, as to the kinds or numbers of mounted recording heads, for example, not only a single recording head is provided corresponding to ink of monochromatic color, but also plural numbers of recording heads may be provided depending on plural recording colors or plural different densities. In other words, the present invention is extremely effective to an apparatus having not only a recording mode in black or the like as the main color, but also another recording mode in a multiple color having different colors or a full color using mixed colors, whether the recording head is integrally formed or it is structured by combination of plural pieces thereof.

Furthermore, as a form of an ink jet recording apparatus embodying the present invention, there may be embodied a copying machine combined with a reader or the like, as well as a facsimile equipment having function of transmission and reception, in addition to an image output terminal for a computer and other information processing equipment.

As described above, the recording apparatus embodying the present invention produces the following effect:

(1) With a second spur that pushes down a sheet material to each of extrusions of a platen, which is arranged more on the downstream side than a first spur in the conveying direction, the reaction exerted by the abutting of a second spur is no longer transmitted to the portion on the recording area of a sheet material, and also, the sheet material is pushed down to each extrusion of the platen by the first spur. As a result, it becomes possible to keep the distance between the sheet material and recording means at a designated value or more. Thus, even if the sheet material expands by the permeation of ink, the sheet material does not float from the platen to make high-quality recording possible on the entire area of the sheet material.

(2) With a second spur being made movable by the reaction of a sheet material against the biasing force, it is possible to maintain the amount of waving of the sheet material optimally depending on the expansion and rigidity of the sheet material for the performance of high-quality recording.

(3) The height of the contact portion between the sheet-discharging roller and the first spur is made almost the same as the height of extruded portions to make it possible for the sheet-discharging roller and each of first spurs to nip and discharge a sheet material without buckling the sheet material

What is claimed is:

1. A recording apparatus for recording on a sheet material by recording means comprising:

conveying means for conveying said sheet material to the recording area of recording means;

a platen provided with plural extrusions for supporting said sheet material in said recording area, said plural extrusions being arranged in the direction intersecting with the conveying direction of said sheet material at designated intervals in a configuration of being extended in said conveying direction;

plural sheet-discharging rollers for conveying a sheet material arranged on the downstream side of each of said extrusions in said conveying direction and in the same position as each of said extrusions in said intersecting direction;

plural first spurs for nipping a sheet material with said plural sheet-discharging rollers for conveyance thereof by being driven to rotate following said plural sheet-discharging rollers; and a second spur arranged on the downstream side of said plural first spurs in said conveying direction and between said plural sheet-discharging rollers in said intersecting direction, for rotating following the movement of a sheet material to push down said sheet material between said plural extrusions, the lowest part of said second spur being arranged to be lower than the uppermost part of said sheet-discharging roller when said sheet material does not abut thereupon.

2. A recording apparatus according to claim 1, wherein the rotational shaft of said first spur is on said platen side with respect to the rotational shaft of said sheet-discharging roller.

3. A recording apparatus according to claim 1, wherein said first spur and said second spur are provided with biasing force to press said sheet material.

4. A recording apparatus according to claim 3, wherein the biasing force against said second spur is made releasable.

5. A recording apparatus according to claim 1, wherein the height of contact portion between said sheet-discharging roller and said first spur is substantially the same as the height of said extrusion.

6. A recording apparatus according to claim 1, wherein said recording means performs recording by discharging liquid to said sheet material.

7. A recording apparatus according to claim 6, wherein said recording means provided with thermal energy generating means for generating thermal energy whereby to discharge liquid, and discharges liquid by creating change of states of liquid by thermal energy generated by said means for generating thermal energy.

8. A recording apparatus for recording on a sheet material by recording means, comprising:

a first conveying roller for conveying said sheet material to the recording area of the recording means;

a platen provided with plural extrusions for supporting said sheet material in said recording area, said plural extrusions being arranged in the direction intersecting with the conveying direction of said conveying roller;

plural second rollers for conveying a sheet material arranged on the downstream side of each of said extrusions in said conveying direction and in the same position as each of said extrusions in said intersecting direction;

plural first spurs for nipping a sheet material with said plural second rollers; and a second spur arranged on the downstream side of said plural first spurs in said conveying direction and between said plural second rollers in said intersecting direction, for rotating following the movement of a sheet material to push down said sheet material between said plural extrusions, the lowest part of said second spur being arranged to be lower than the uppermost part of said sheet discharging roller when said sheet material does not abut thereupon;

wherein said second spur contacts a leading edge of the sheet material conveyed by said first conveying roller after said plural first spurs contact the leading edge of the sheet material conveyed by said first conveying rollers.

* * * * *

UNITED STATES PATENT AND TRADEMARK OFFICE

CERTIFICATE OF CORRECTION

PATENT NO. : 6,712,463 B2
DATED : March 30, 2004
INVENTOR(S) : Toshiya Matsumoto It is certified that error appears in the above-identified patent and that said Letters Patent is hereby corrected as shown below:

Title page,
Item [56], References Cited, FOREIGN PATENT DOCUMENTS,
"06115068" should read -- 6-115068 --; "10297039" should read -- 10-297039 --; and "2000071532" should read -- 2000-071532 --.

Column 1,
Line 64, "Illustrate" should read -- illustrate --.

Column 2,
Line 61, "is,provided" should read -- is provided --.

Column 3,
Line 26, "tion:" should read -- tion; --.

Column 5,
Line 30, "contact" should read -- contact. --.

Column 6,
Line 21, "line In" should read -- line in --.

Column 10,
Line 8, "thereupon;" should read -- thereupon, --.

Signed and Sealed this

Seventeenth Day of August, 2004

JON W. DUDAS
*Acting Director of the United States Patent and Trademark Office*